United States Patent [19]

Dilmore

[11] 4,224,019

[45] Sep. 23, 1980

[54] POWER BURNER FOR COMPACT FURNACE

[75] Inventor: James A. Dilmore, Irwin, Pa.

[73] Assignee: Westinghouse Electric Corp., Pittsburgh, Pa.

[21] Appl. No.: 881,474

[22] Filed: Feb. 27, 1978

[51] Int. Cl.[3] ..... F23D 13/40; F23D 13/14

[52] U.S. Cl. ..... 431/328; 431/354

[58] Field of Search ..... 431/328, 329, 47, 354

[56] References Cited

U.S. PATENT DOCUMENTS

| | | | |
|---|---|---|---|
| 1,215,229 | 2/1917 | Willson . | |
| 2,018,582 | 10/1935 | Thuenissen | 431/328 |
| 3,032,096 | 5/1962 | Stout | 126/91 |
| 3,489,134 | 1/1970 | Cowan | 146/91 |
| 3,635,644 | 1/1972 | Reid, Jr. | 431/9 |
| 3,691,764 | 9/1972 | Ware | 431/328 |
| 3,762,390 | 10/1973 | Mendelson | 431/328 |
| 3,801,212 | 4/1974 | Cutler | 404/95 |
| 3,938,936 | 2/1976 | Vizmeg | 431/47 |
| 4,063,873 | 12/1977 | Niato | 431/328 |

*Primary Examiner*—Samuel Scott
*Assistant Examiner*—Wesley S. Ratliff, Jr.
*Attorney, Agent, or Firm*—E. C. Arenz

[57] ABSTRACT

A compact gas power burner is provided which includes a cylindrical mixing tube into which combustion air is discharged tangentially from a centrifugal blower located adjacent the closed end of the mixing tube, and gaseous fuel is admitted into the discharge airstream of the blower upstream from the admission location of the airstream into the mixing tube so that the swirling component of the air in the mixing tube during its passage to the open end of the tube will promote the mixing of the air and gaseous fuel, the mixing tube being provided with a honeycomb ceramic disc at its end to which it is attached to a cylindrical heat exchanger, and ignition means and flame sensors are provided on the downstream side of the ceramic disc.

4 Claims, 2 Drawing Figures

POWER BURNER FOR COMPACT FURNACE

FIELD OF THE INVENTION

Figure 1:
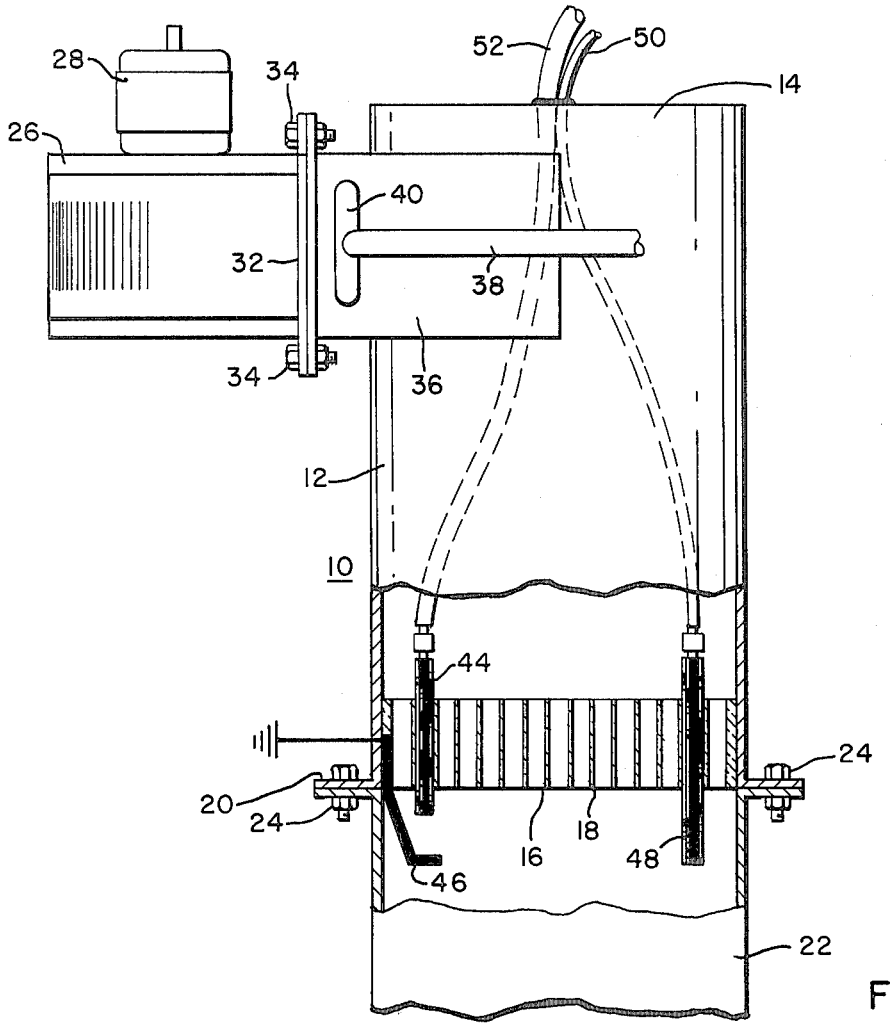

The invention pertains to the art of powered gas burners of the compact type typically adapted for use in a compact residential furnace.

GENERAL BACKGROUND AND PRIOR PATENT ART

The typical residential furnace uses a plurality of natural or gravity draft burners in conjunction with a so-called clam shell type heat exchanger. Such heat exchangers typically are of the sectional design with individual sections connected near the bottom and connected to a common flue-gas breeching at the top with an individual burner at the bottom of each section. Such heat exchangers do not lend themselves to installation in a so-called compact furnace which typically requires a tubular heat exchanger coupled with a forced draft or power burner. However, with a power burner to be used in a domestic compact furnace there are relatively stringent technical requirements, as well as cost and size requirements from a manufacturing and marketing standpoint. As to the technical requirements, the American Gas Association sets performance levels on the flue temperature, materials temperatures, and carbon monoxide concentration in the flue which results in a minimum efficiency for AGA certification. To market a compact furnace competitively, the cost of manufacture of the furnace must be kept relatively low. If the furnace is to be considered compact, it must be of limited size. In my view, if all of these requirements are to be met, the attainment of good fuel-air mixing is relatively difficult since a low air pressure requirement restricts the mixing levels, exotic mixing devices such as vanes, etc. increase cost, and the size restrictions for a compact burner require that good mixing take place in a relatively short distance. While gaseous fuel can be injected into the inlet of a combustion air blower to get good fuel air mixing, the code restrictions require with such an arrangement that the motor be explosion proof, which of course adds significant cost.

As to the prior patent art, examples of patents showing power gas burners in which the air is fed axially into a mixing chamber or combustion chamber include U.S. Pat. Nos. 3,801,212, 3,489,134, 3,032,096. Examples of burners using a refractory material at a combustion location include U.S. Pat. Nos. 3,635,644 and 1,215,229. An example of a U.S. patent showing the introduction of primary air and secondary air of combustion in a tangential arrangement is found in U.S. Pat. No. 2,018,582. It is my view that none of these arrangements would be satisfactory to meet the objects of the arrangement according to my invention.

SUMMARY OF THE INVENTION

In accordance with my invention, there is provided a gaseous fuel power burner which includes a cylindrical mixing tube with an open burner end and an opposite closed end, with a centrifugal blower structurally carried by the tube and having an outlet connected to a circumferential portion of the mixing tube adjacent the closed end to discharge air generally tangentially into the mixing tube adjacent the closed end, with means provided for delivering gaseous fuel into the discharge airsteam of the blower upstream from the admission location of the airstream into the mixing tube to utilize the swirling component in the mixing tube to promote the mixing of the gas and air in the passage of the gas and air through the mixing tube, with an open work refractory member extending across the open burner end of the mixing tube, and with ignition means and flame sensors at the burner end of the mixing tube.

With this arrangement, the burner unit assembly is relatively compact, uses a combustion air blower which produces a low pressure well below the maximum, is low in cost and can operate over a range of inputs and a variety of gases without modification.

DRAWING DESCRIPTION

Figure 2:
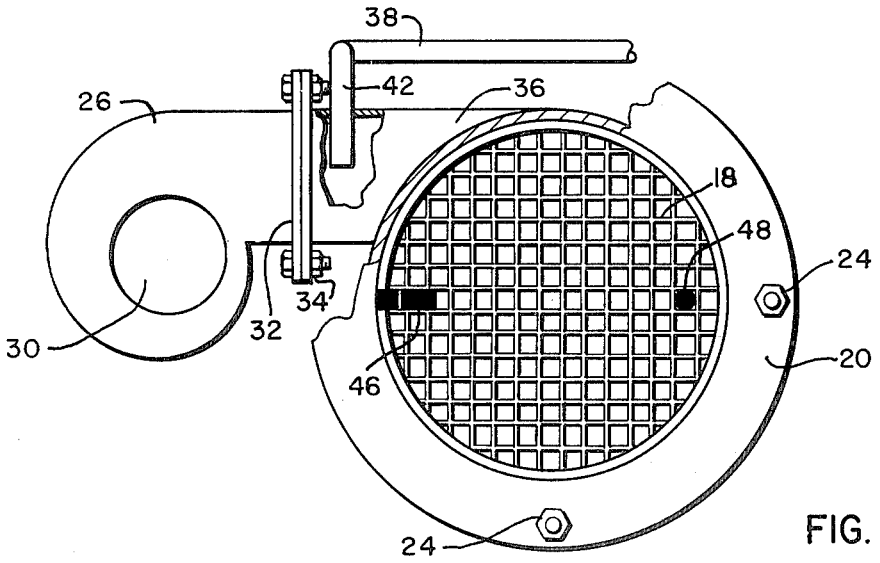

FIG. 1 is a partly broken top view of a power burner according to my invention in attached relation to a fragmentary portion of a heat exchanger; and FIG. 2 is a front view of the burner assembly as viewed looking at the open end of the mixing tube.

Referring to FIGS. 1 and 2, the compact power burner unit according to the invention includes a cylindrical mixing tube generally designated 10 having a circumferential side wall 12, a closed end wall 14, and an opposite open end 16 in which is situated a disc of open-word refractory material such as a honeycomb ceramic element 18. The open end 16 has a circumferential flange 20 which seats against and seals with the heat exchanger 22, to which it is attached by means of bolts 24.

A centrifugal blower 26 driven by electric motor 28 is used to provide combustion air for the burner unit. the blower has at least one inlet 30 (FIG. 2) and a flanged outlet 32 which is connected as by bolts 34 to a facing, flange transition element 36 which connects the outlet to the circumferential side wall 12 of the mixing tube. In the illustrated arrangement a standard low cost centrifugal blower 26 is used which is in turn supported from the rectangular transition duct 36 through the bolted flanges, with the transition duct in turn being connected as by welding or other suitable means to the circumferential side wall 12 of the mixing tube. As such, the centrifugal blower is structurally carried by the mixing tube and by simply disconnecting the mixing tube from the heat exchanger 22 through the removal of the bolts 24, the burner unit as a whole may be removed from the furnace vestibule in which it is situated. It will be appreciated that the blower 26 and transition 36 may comprise an integral unit in which the side walls and scroll of the blower are extended and without the intervening flanges, and in turn be attached to the mixing tube circumferential wall.

The end of the transition 36 which is attached to the circumferential wall of the mixing tube is of course open, and as may be seen in FIG. 2, the top wall of the transition is generally tangent with the circumferential wall of the mixing tube. As a result, the discharge air from the blower is directed generally tangentially into the mixing tube so that the air in its passage toward the open end of the mixing tube includes a swirling component which in effect increases the length of the path of the air between its entrance into the mixing tube and its exit from the end of the mixing tube.

The gaseous fuel is fed to the burner unit through a main delivery tube 38 which connects to a tee 40 which in turn is connected to two gas distribution legs 42 which extend down into the transition member 36 so that the gaseous fuel is injected into the blower discharge upstream from the admission location of the blower discharge air into the mixing tube. The number of injection points will be a function of gas flowrate (furnace capacity). As a result, the gaseous fuel will be carried into the mixing tube with the discharge air and be subjected to the swirling component of the air in its passage through the mixing tube so that mixing of the fuel and the air is promoted.

The ignition means for the burner unit includes a high voltage electrode 44 which may conveniently be carried by the honeycomb ceramic disc 18 which serves to both support the electrode, and to electrically insulate it from the metallic mixing tube which has connected thereto the ground electrode 46. The ceramic disc may also conveniently be used to support a flame sensor 48. Both the capillary tube 50 for the flame sensor and the conductor 52 for the high voltage electrode may conveniently enter the mixing tube at its closed end 14 through a grommet and extend to the sensor and element.

It is noted that the ceramic not only supports the elements 44 and 48, but also serves as a flame holder so that all combustion takes place in the heat exchanger 22 beyond the disc while all the controls, connections and fuel-air mixing takes place in the burner unit. With this arrangement, the burner unit as a whole is easily removed by simply removing the flange bolts 24 and removing the unit from the furnace vestibule. Also, the ceramic structure has a low thermal conductivity which provides flashback prevention in the case of reduced air flow due to reduced voltage and/or reduced gas flow due to either control malfunctions or reduced gas pressure.

I claim:

1. A gaseous fuel, power burner comprising:

a mixing tube having an open burner end and an opposite closed end;

a centrifugal blower structurally carried by said mixing tube and having an outlet connected to a circumferential portion of said mixing tube adjacent said closed end to discharge air generally tangentially into said mixing tube adjacent said closed end;

means for delivering gaseous fuel into the discharge airstream of said blower upstream from the admission location of said airstream into said mixing tube so that said gaseous fuel and air will have a swirling component to promote mixing in the passage of said gaseous fuel and air through said mixing tube;

an openwork refractory member extending across the open burner end of said mixing tube; and ignition means including a high voltage electrode at said burner end of said mixing tube, for initiating combustion of the mixed fuel and air on the downstream side of said refractory member.

2. A burner according to claim 1 wherein said gas delivery means comprises at least two outlet nozzles.

3. A burner according to claim 1 wherein said open work member comprises a honeycomb ceramic disc; and said disc supports said high voltage electrode and electrically insulates it from said mixing tube.

4. A burner according to claim 3 including:

a flame sensor carried by said ceramic disc.

* * * * *